US005731763A

United States Patent [19]

Herweck et al.

[11] Patent Number: 5,731,763

[45] Date of Patent: Mar. 24, 1998

[54] VIDEO/TV ACCESS CONTROLLER

[76] Inventors: Steve A. Herweck; Mathew S. Herweck, both of 12 Lansing Dr., Nashua, N.H. 03049

[21] Appl. No.: 413,457

[22] Filed: Mar. 30, 1995

[51] Int. Cl.[6] ..... H01H 9/02; H01H 9/54

[52] U.S. Cl. ..... 340/825.69; 200/43.22; 220/252; 340/825.72; 361/654; 361/658; 439/535; 439/901; 439/915

[58] Field of Search ..... 174/53; 200/43.22, 200/61.93, 293; 206/330; 220/210, 252, 253; 340/825.22, 825.69, 825.72; 361/636, 641, 654, 658, 740; 439/133, 535, 536, 892, 901, 915, 950

[56] References Cited

U.S. PATENT DOCUMENTS

| | | | |
|---|---|---|---|
| 4,279,012 | 7/1981 | Beckedorff et al. | 340/825.22 X |
| 4,591,657 | 5/1986 | Masters | 220/210 X |
| 4,686,380 | 8/1987 | Angott . | |
| 4,959,647 | 9/1990 | Daigle | 340/825.72 |
| 5,099,193 | 3/1992 | Moseley et al. | 340/825.72 X |
| 5,189,412 | 2/1993 | Mehta et al. | 340/825.22 |
| 5,382,947 | 1/1995 | Thaler et al. | 340/825.22 |
| 5,481,251 | 1/1996 | Buys et al. | 340/825.22 |

FOREIGN PATENT DOCUMENTS

| | | | |
|---|---|---|---|
| 63-291327 (A) | 11/1988 | Japan | 340/825.72 |
| 2 210 187 | 6/1989 | United Kingdom | 340/825.72 |
| 2 210 217 | 6/1989 | United Kingdom | 340/825.22 |
| 88/07246 | 9/1988 | WIPO | 340/825.72 |

OTHER PUBLICATIONS

*TV Guard* product packaging and instruction brochure. No Date.

*SDI Pocket Remote Power Control* catalog excerpt. No Date.

*Time Slot* catalog excerpt. No Date.

*Stanley* miniature transmitter packaging instruction. No Date.

*Genie Remote In-house Light Control* product packaging. No Date.

*Connect-a-Plug* product packaging. No Date.

*Primary Examiner*—Michel Horabik

*Assistant Examiner*—William H. Wilson, Jr.

*Attorney, Agent, or Firm*—Lahive & Cockfield, LLP

[57] ABSTRACT

An access controller for a television, computer or display device includes a wireless transmitter and a receiving unit. The receiving unit has a tamper-proof housing that covers the device power line and protects receiving and switching circuitry. The receiving circuitry receives and demodulates a control signal sent by the transmitter, and drives the switching circuitry between ON and OFF states. In a preferred embodiment, the housing has opposed halves which close about the device plug. A pigtail line cord extends from the housing and provides power through the switch, to the device plug. The housing itself is featureless, and the transmitter is an inconspicuous, pocketable, push-button device, so the TV or other device may be controlled without physically approaching or otherwise revealing either the nature of the control mechanism or even that the operator is exercising control. This effectively conceals the presences and operation of the switch from discovery, preventing behavioral problems associated with parent-child enforcement situations. Preferred embodiments involve a simple clamshell or clamp-on box, which may be permanently or releasably locked on the line cord.

12 Claims, 4 Drawing Sheets

VIDEO/TV ACCESS CONTROLLER

BACKGROUND

The present invention relates to devices for controlling access to a domestic video system, particularly a video game, television or personal computer video display, or devices interfaced with such video display, such as a CD-ROM player or the like. A general problem associated with home television, video games and computers is that each of these devices, while offering opportunities for education, entertainment and cultural enrichment, can, through fascination or boredom, occupy children for an inordinate period or proportion of time, and detract from other useful activities and growth in a child's life. Accordingly, parents generally ration access to television and video games. However, the very nature of these devices, which are designed for simplicity of control making them accessible to children, invites abuse. Furthermore, the fact that parents rely on such entertainment to occupy children and free themselves from distracting interactions makes it difficult for many parents to enforce a fixed set of rules governing access to TV. Thus, while television viewing or game playing is often treated like a weekly allowance in which a specified quota may permissibly be enjoyed, it is an allowance which is subject to numerous exceptions that often depend on the particular circumstances, and surrounding events, and on the will or attentiveness of parents as well as the obeisance or behavior of children. Television viewing in short, and access to or permission to engage in television viewing, is often a domestic arena in which the basic issues of family rules and behavioral expectations are tested or displayed.

Because of the easy accessibility of television viewing, children often learn to take matters into their own hands and come to disregard parents' rules or guidelines, viewing them as a necessary but acceptable risk, to be followed only after first breaking them to determine if the parent is watching or seriously concerned. While such informality can be a sign of a relaxed family authority structure, it may also lead to more complex patterns of family behavior, and to "systems" in which token obedience to a pretend authority substitutes for true responsibility or honest relationships between parents and children. Thus, factors of enablement or co-dependence which surface in later life situations of relationships involving compulsive or addictive behavior may even be seen in patterns of domestic television and video activity.

Accordingly, it would be desirable to provide some means for allowing parents to objectively set permissible patterns of access to forms of video entertainment, and to enforce patterns of daily behavior as a matter of course, without having to resort to continual oversight, or the need to verbally justify the reasons for a general rule of restraint, in the face of the always-present attraction of simple and available entertainment. It might be desirable, for example, to have a simple control box in which a parent can program either the total number of hours, or the particular hours in which, for example, a television or a cable channel converter are turned on. However, it is an unfortunate fact that most children are better at programming such things and that many adults remain unable to easily or correctly operate keyboard programmable devices. Furthermore, children may routinely bypass or subvert the wiring or plug connection of equipment of this type. Accordingly, what is needed is an access control unit that is simple to operate, relatively unobtrusive or invisible and cannot be bypassed in practice.

SUMMARY OF THE INVENTION

These and other desirable features are attained in a device for securing an electrically operated display, such as a TV or video game against unauthorized use, wherein the device connects to the power line of the video unit and disconnects the power when commanded remotely. The device includes a transmitter unit which transmits a wireless security signal when actuated, and a receiving unit which receives and implements the wireless security signal by switching the power line. Preferably, the receiving unit is housed in a tamper-proof housing which assembles over the power line of the video device, and which, in turn, contains a regular domestic line plug so that all power entering the video device must pass through or be controlled by the receiving unit. The receiving unit includes a first means tuned to receive the wireless security signal and produce an indication of reception, e.g., by changing state or providing a relay tripping voltage, and a switch or relay responsive to that indication for changing between an OFF and an ON state. The switch is connected to a main power line of the video apparatus, and the tamper-proof housing encloses the power line as well as the receiving unit. Thus, actuation of the transmitter disables the electrically operated video device, and the switch cannot be bypassed to provide power to the power line for operating the device without telltale destruction or tampering of the housing. In a preferred embodiment, the tamper-proof housing is a polymer case adapted to receive and secure the plug of a television or computer line cord. A second line cord is placed in circuit with the television cord through the switch, and the housing lockably or irreversibly encloses both the cord and the operative elements of the receiving unit.

In another embodiment, the receiving unit and relay or switch are located within the housing of a television set itself, and are attached to internal power wiring of the set. In this embodiment, the tamper-proof back of the television acts as a tamper-proof housing to keep the receiving unit and its security features inaccessible and operative. The receiver provides a switch or power cut-off in series with the normal circuitry. In use, the switch toggles between ON and OFF states, and the transmitting unit sends a signal which is selectively received and recognized by the receiving unit. This signal may be a narrow band radio signal, a radio or light signal which is coded or modulated with a security or identification code, or may be another specialized signal such that the receiving unit responds selectively only to a transmitter unit, which has been specifically configured for operation therewith. That is, the transmitter effectively acts as a key for the receiving unit to provide authorization signals which switch the receiver between ON and OFF states. Once switched, the switch remains in its current state until another transmission signal is received.

Thus, the device operates as a lock, limiting access to, or more exactly limiting the ability to operate, of the video device or the electrical equipment to which it is attached.

BRIEF DESCRIPTION OF THE DRAWINGS

These and other features of the invention will be understood from the description which follows, taken together with the drawings herein, wherein FIG. 1 schematically illustrates the control device according to the present invention.

DETAILED DESCRIPTION OF THE DRAWINGS

Figure 1:
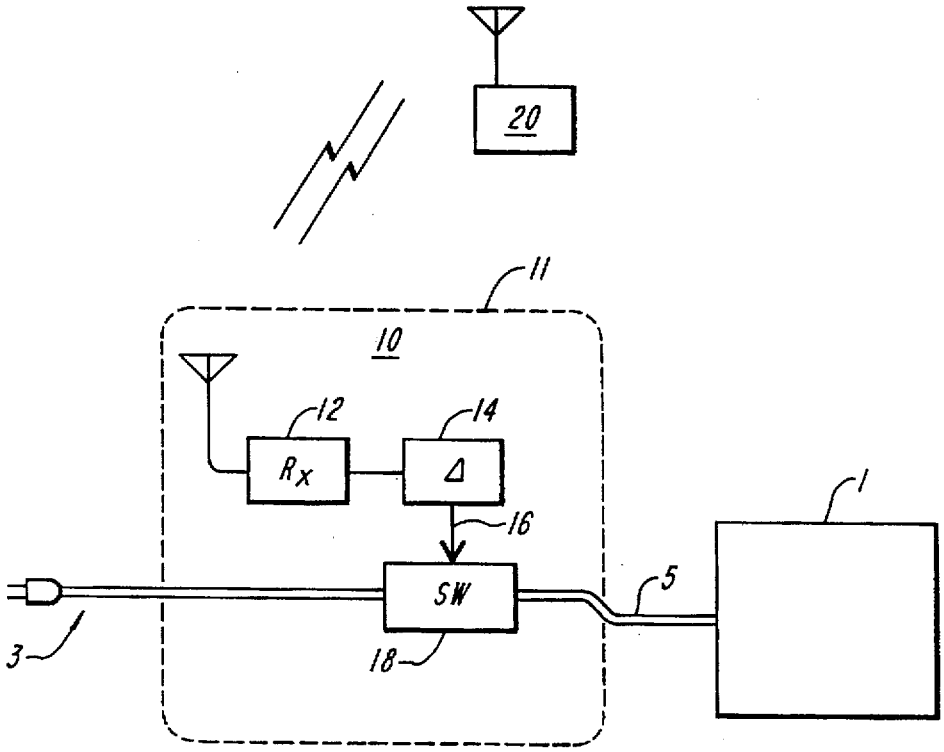

As shown in FIG. 1, a modular control 10 according to the present invention connects to a main power or circuit line 5 of a TV video or other display electronic device 1 to selectively allow or disrupt passage of power between the ultimate source, shown as a common domestic electric plug 3, and the device 1. The device 10 is enclosed, as indicated schematically by the dashed line enclosure 11, and includes a signal receiver 12 for receiving control signals, a discriminator 14 for evaluating received signals and passing an output along switch control line 16 when a suitable signal is identified, and a switch unit 18 which connects directly to the power circuit line 5 and controls power therealong so that the device 1 is operable or inoperable depending on the state of switch 18. The system also includes a transmission unit 20 for wirelessly transmitting signals to the modular control 10 in a form to pass the discriminator 14 and operate the switch 18. For example, transmission unit 20 may impress a radio or communications frequency carrier F with an identification or information signal, such as a digital code, or may modulate the carrier with a fixed or given sequence of frequencies, or may modulate the amplitude of the transmission in an identifiable pattern, such that receiver 12 responds to the transmission to produce the identified pattern and actuate or pass the discriminator 14. In the simplest case, the transmission may occur on a single narrow band fixed frequency, and the "code" may simply consist of selecting this particular transmission frequency, which remains fixed. In this case, the device provides security against unauthorized use in that there is only a very small probability that a transmitter made for use with another receiving unit would be tuned to operate at the same frequency as the transmitter tuned for this receiving unit. For example, receivers may operate in the 900 megahertz band and each matched pair of receiver transmitter units may be tuned to a frequency that differs by several kilohertz from each other pair. In this case, the receiver is a narrow band receiver, and the discrimination unit 14 is part of the receiver or transmitter tuning circuit. In other, somewhat more complex embodiments, the transmitter may modulate a carrier with a digital code word or tone signal. In that case, the discriminator unit 14 of the receiver then decodes the code word or demodulates the carrier and changes state only in the event the correct word or tone is identified in a transmission. In this case, a vast number of different code words or tone sequences may be generated so that every receiver/transmitter pair has a different code than every other one, and the possibilities of a child evading the security features by using another transmitter are negligible. Other embodiments are also possible, for example, a transmission scheme in which the transmissions are impressed with a short, e.g., four, eight or ten bit, code which is initially user-selected by setting the positions of a like number of separate two-position switches. In this case, the transmitter and the receiver are set to operate with the same code sequence and two or more receivers may be set by the user to respond to an identical code. With this embodiment, many different units, for example, one or more televisions, a computer video game, and a personal computer, may all be set to respond to the same hand-held transmission unit.

Figure 2:
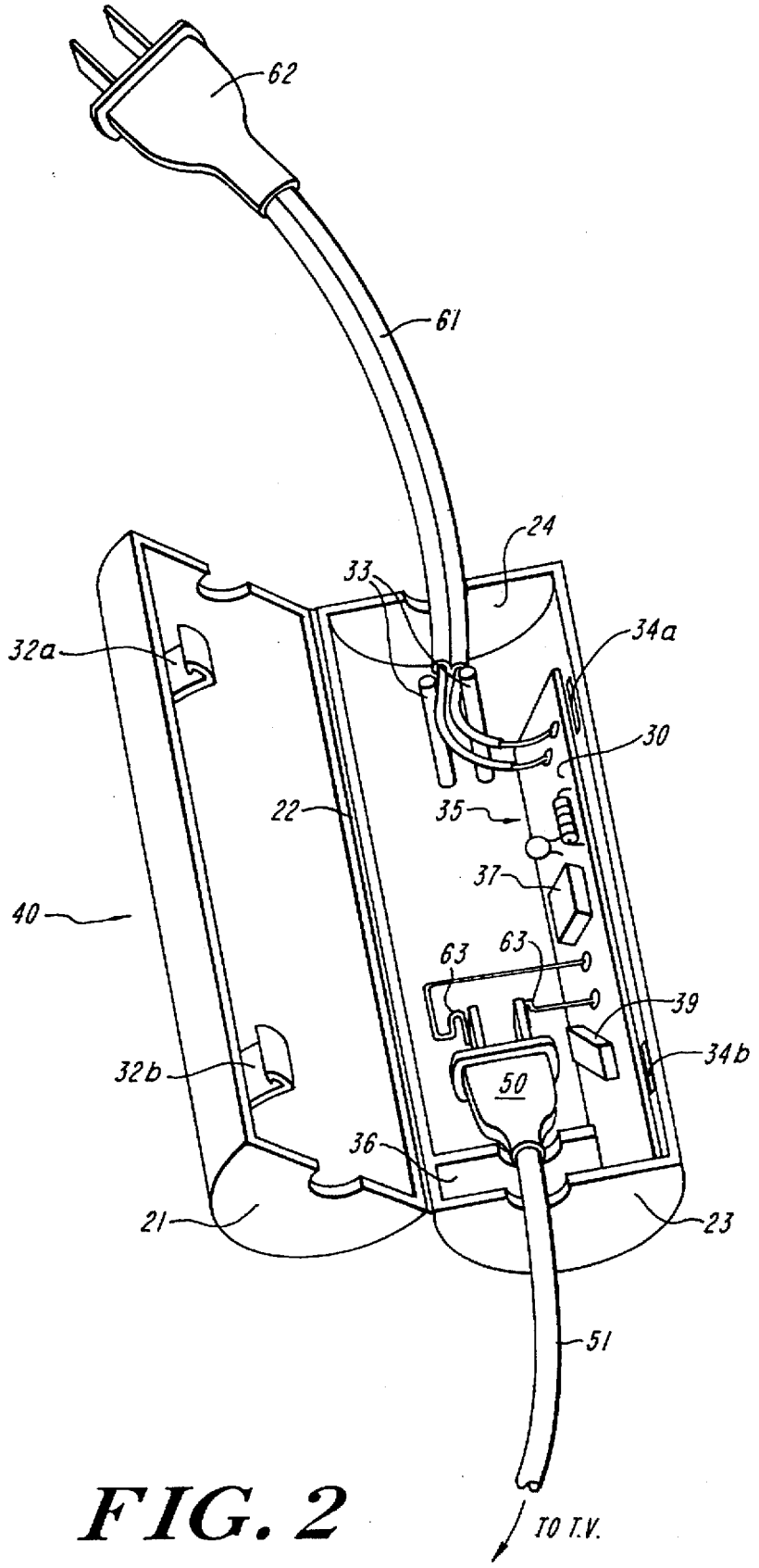
FIG. 2 illustrates a line cord embodiment of the invention of FIG. 1.

FIG. 2 shows an embodiment 40 of the present invention adapted for use with a home television set. In this embodiment 40, an elongated housing 21 is adapted to enclose the end plug 50 of a TV line cord 51. The housing 21 is illustrated as an injection molded, flexible plastic housing which is hinged along a flexible hinge line 22 and has first and second ends 23, 24 in what is otherwise a generally cylindrical or box-like housing. The housing 21 encloses a circuit board 30 having signal receiving, discriminating and switching elements as described above, and the housing has end openings 23, 24 in which the television line cord 51 enters, and a domestic line cord 61 exits, for plugging into a wall outlet power source. Preferably, the outlet line cord 61 is a relatively short length of electrical cord, only about six inches long, and has a standard electrical plug 62 on the end thereof. This short cord allows the unit to conveniently plug into the back of a television tuner, amplifier or in a chassis socket array such as is commonly found on a consumer electronics control center. Conventional power control boxes of the type used to control lights tend to not fit in socket arrays, as they are formed in boxes primarily designed around the shape of a generally rectangular printed circuit board and they extend laterally too far such that they are limited to plugging into wall sockets or regions where there is at least an inch or two of clearance on the side, or possibly along two directions, around the socket. While the prior art arrangement works well liar wall sockets, the present invention is intended to fit as a controller of electronic items which may plug into either a wall or a control socket array which are more tightly spaced.

As illustrated in FIG. 2, the circuit board 30 connects at one end to the incoming power source line 61, and has various circuit elements schematically illustrated as a high Q tuning section 35, a discriminator circuit 37, and a power switch or relay 39 arranged on the board to switch the power from line 61 to connect to socket clips 63 which contact the prongs of the television plug 50. Thus, the plug 50 is placed in communication with the power line 61 in accordance with whether or not the relay 39 has been turned on or off by the receiving and discriminator elements 35, 37.

The molded housing 21 also has a plurality of protruding pins 33, which, as shown, are arranged to wedge against the line cord 61, or against a knot formed in the line cord so as to prevent the transmission of stress from the cord to the delicate circuit board, and prevent the dislodgment of line contacts connecting to the end of the board 30. Similar protrusions may be provided at the TV socket end to secure the plug 50 and/or the appliance line 51 (shown in phantom) from dislodgment or stress. Various arrangements are known in the art for mounting a power line cord in chassis assemblies, including the provision of movable pins or movable plates to bear against the socket 50 and secure it in position against axial motion, and other such arrangements. Any of these may be employed in the present invention to adapt the housing and circuitry 30 to any of a variety of sizes of appliance cord 51 such that specialized grommets and the like are not required. As noted above, housing 22 hinges open along a hinge line 21 which flexes, allowing the assembly to be closed entirely about the cord 51. A pair of protruding hooks **32*a*, 32*b* extend along one side of the top portion of the clamshell housing and mate with corresponding hooks 34*a*, 34*b* on the other side so that once the assembly is closed, the housing is effectively locked and cannot again be opened. A plurality of cross struts 36, of which one is shown, may be provided to prevent bending or deformation of the side wall of the housing, so that even prying with a screw driver or bending at the edge will not release the hooks 32, 34. Thus, this remotely controlled switching device 40 fastens to a television line cord and encloses the cord in a tamper-proof way, placing it in a remote-controlled switch circuit to prevent provision of power to the television unless or until enabled by the hand-held transmitter 20 (FIG. 1). In other embodiments, the permanently clasping hooks 32, 34 may be replaced by a releasable locking mechanism, such as a cylinder-and-key mechanism. Furthermore, the housing 21** may be formed in two or more pieces or in other shapes, such as a rectangular control box shape.

According to a principal aspect of the present invention, the switch control operation is effectively "transparent," or "invisible," in the sense that the unit itself is designed to look like a normal or incidental line cord or television accessory box, and it is actuated by a separate push button in a small hand-held unit which need not itself be visible at the time of actuation. This switching is done remotely so that an adult or person in charge of monitoring a child's television usage need not be physically present in the room to operate the control and the act of control may not itself be apparent. All of these factors are believed to be important for establishing limits for a child's television watching-behavior, especially in situations where dependent or co-dependent reinforcing behavior patterns, such as begging, bargaining, or temper tantrum or admonishment occur in the context of parental limit-setting. The inconspicuous remote control in-line switch device allows television disabling to be performed without ostentation or histrionics, and in a neutral or even mysteriously incomprehensible manner which discourages the aforementioned forms of inappropriate transactual behavior. Furthermore, younger children may be brought up to expect, for example, that the TV simply does not operate during certain fixed hours, without having to articulate this fact as a "rule of the house", or reveal the actions taken to disable the television.

Thus, according to this aspect of the invention, the receiver unit is "featureless". As used herein "featureless" means that the receiver/control unit lacks any obvious buttons, knobs, wire attachment screws, or controls, and has the natural or innocuous appearance of a normal piece of accessory hardware for line attachment such as a surge protector, plug or impedance matcher. The fact that the transmitter is small enough to be concealed further contributes to the featurelessness of the device. Furthermore, while the receiver may have a keyhole or lock as described for the embodiment of FIGS. 3A–3B below, preferably any form of releasable latch or lock is an entirely invisible or concealed one (such as a magnetically operated latch) or one which does not appear lock-like (such as a latch actuated by a specially-shaped plastic member unlike a conventional key). The receiver unit may receive its power from the line cord 61, so it is not necessary to open it for replacement of batteries or the like. However, opening is required in order to move it from one set to another, as is commonly required, so some form of releasable latch is preferred. The housing may be made secure but openable by having one or more screws secure the halves of the unit together. In that case, the screw heads may be concealed beneath a product label that is adhesively attached over one surface of housing.

Figure 3A:
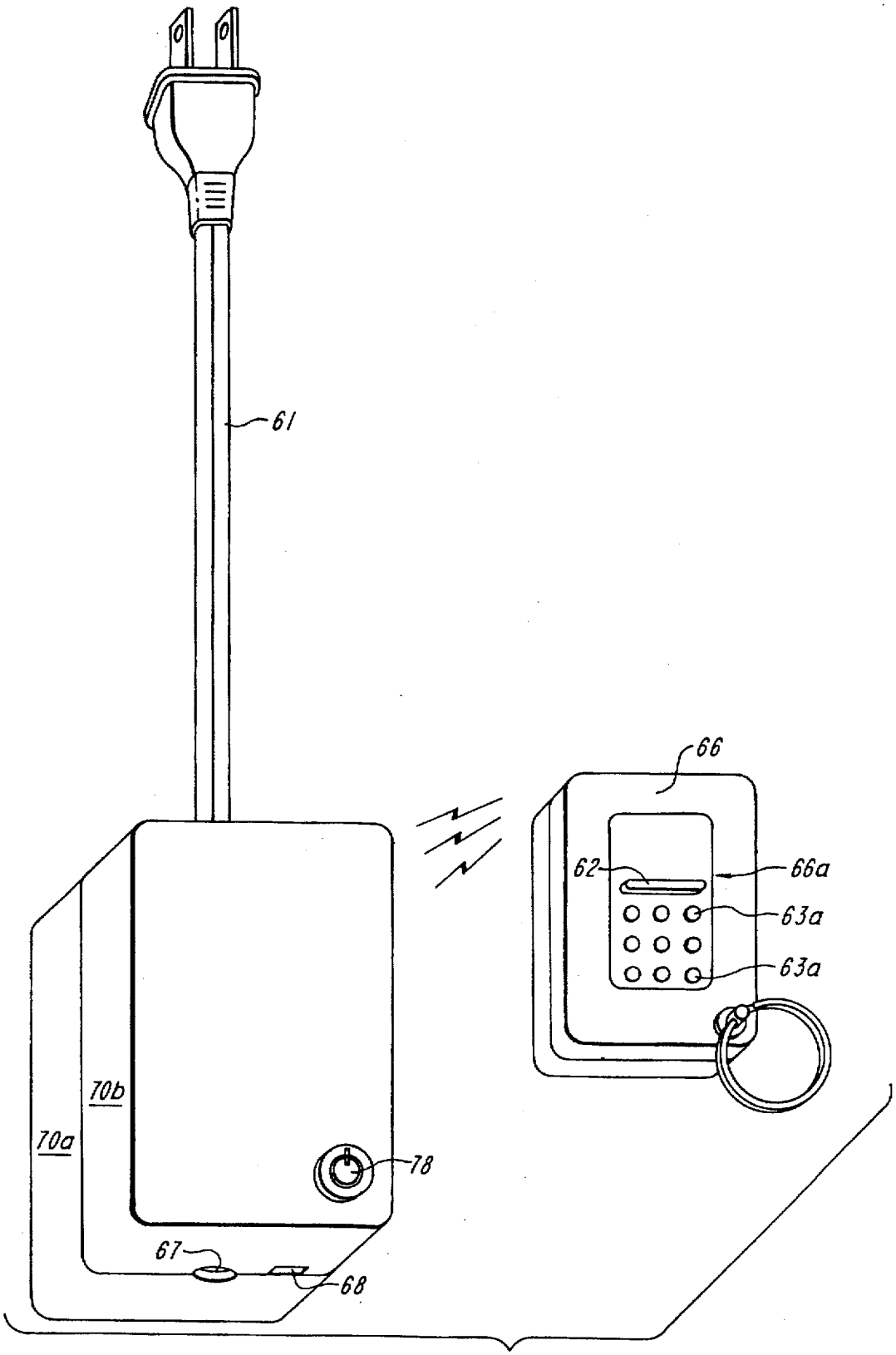
FIGS. 3A–3 B illustrate details of another embodiment of the invention.
Figure 3B:
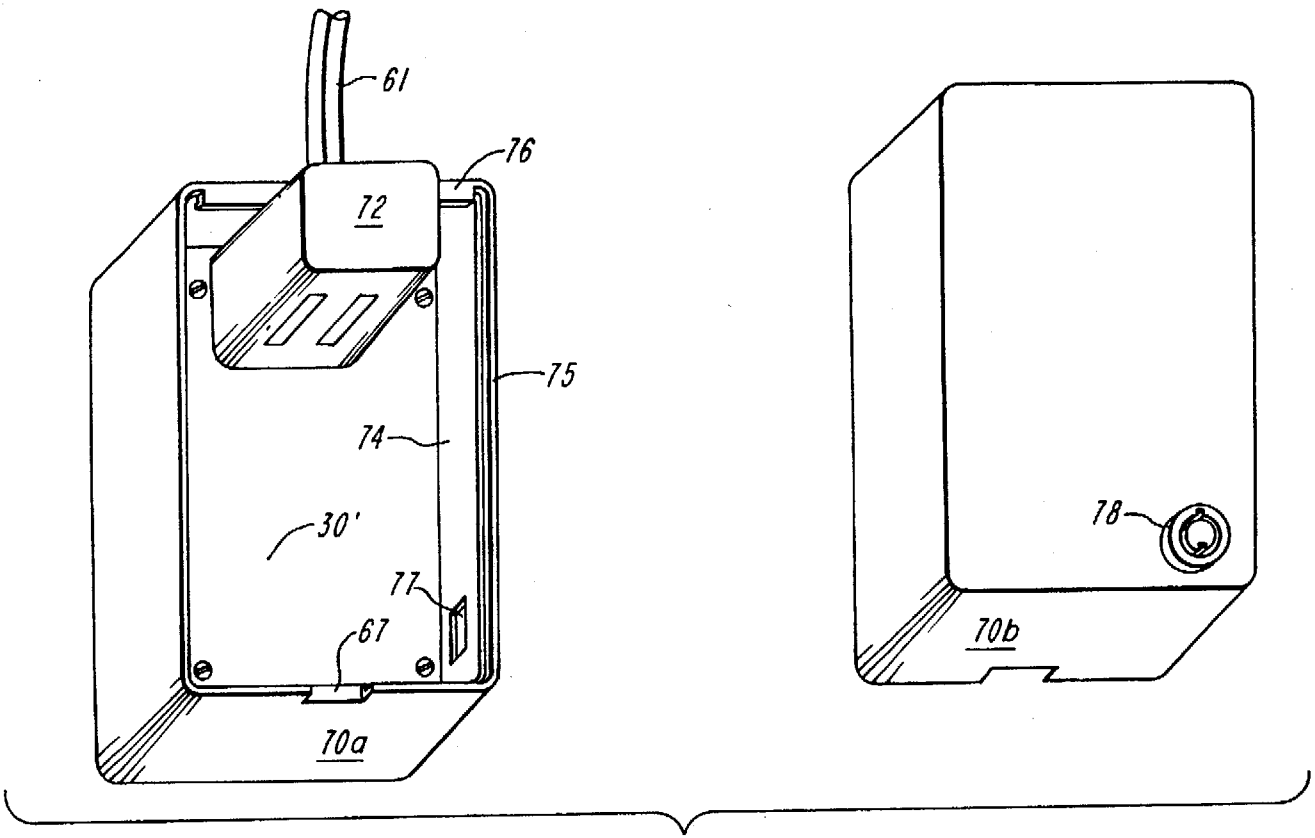

In yet another embodiment of the invention, as shown in FIGS. 3A–3B, the control unit takes the form of a two piece in-line box 70 controlled by a transmitter 66. As in the embodiment of FIG. 2, the receiver 70 has a short pigtail line cord 61 extending therefrom. As illustrated, a lock 78 of conventional type secures the top half **70*b* onto the bottom half 70*a* of the housing. Also visible in FIG. 3A is a TV line cord opening 67 in the housing, and a narrow notch or pry hole 68 into which a screwdriver or coin may be inserted to pry the pieces of the housing apart to aid in separating the box for installation or removal. As in the first embodiment, the housing is essentially plain and featureless, being designed to fit on the TV line cord without drawing attention to itself. As illustrated in more detail in FIG. 3B, the housing 70 of this embodiment includes a lower portion 70*a* and an upper portion 70*b* which fit together to form a closed box. Portion 70*a* contains the active circuit parts of the device, while portion 70*b*** is essentially a locking cover which closes the assembly.

Inside of the lower portion **70*a* a plate 30' which may, for example, also be the printed circuit board, is provided over the receiver and switching circuitry, essentially defining a false bottom of the device. A switched socket 72 and the power cord assembly 61 are attached thereto. The TV line cord entry opening 67 is at the opposite end of the device, and the sidewalls denoted generally 74 have surrounding edges which extend upward from the lower portion for fitting against the upper portion 70*b*. Sidewalls 74 include a stepped or fitted inside lip 75 such that the upper portion fits tightly thereon. The lower portion 70*a* of the box also has a half-hinged lip 76 along one end of the device, and a corresponding cover hinge lip is provided on portion 70*b*. With this arrangement, the cover portion 70*b* fits under the lip 76 and rotates or hinges down to nest partly recessed under the inside lip of wall 74, so that it fits tightly and provides a form of closure which is secure against bending and prying. A recess or protrusion 77 also formed in wall 74 in a position to engage a rotating cam lock 78 situated in the lower right/hand corner of the top portion. Lock 78 is preferably a conventional cylinder lock or other relatively secure and tamper-resistant lock mechanism, in which a cam or radially extending arm or nub is brought into engagement in or under the wall locking recess 77**. Thus, once the outer cover is placed under the hinge and rotated down nesting in the lower portion, it locks securely.

Alternatively, rather than a key lock as shown, an internal, tamper-proof single use locking assembly may be provided. For example, the mating halves **70*a*, 70*b* may contain mating sets of protruding toothed or barbed pins, and receiving toothed counterbores or sockets, which push together to lock the two pieces firmly together when the top is pressed down onto the bottom. When such elements are used to close the assembly, the outer surface of box 70 presents no lock or fastener holes, nor any indication which would invite a person to tamper with or attempt to open it. In addition, all adjoining edges are either covered, for example by the halt-hinge lip 76, or are concealed within the joining region, for example by the edge band lip 75** extending around the remainder of the box.

FIG. 3A further shows the transmitter unit 66 having a relatively small keychain size, with a control panel **66*a*. Panel 66*a* includes a momentary contact transmit button 62, as well as optional keys 63*a*. Button 62 initiates the coded or narrow band transmission to a receiver, while the keyboard buttons 63a** are useful in further embodiments of the invention, such as for setting a transmission code, or performing conventional television control functions, such as channel selection and volume or brightness settings.

As noted above, the present invention contemplates a remote electrical lock which operates in addition to any remote control or ON/OFF circuitry of a device. It is installed by an unskilled user onto a conventional line cord, and is coded or selectively controlled in such a way that only the user has access to control the possibility of operating the electrical device. The assembly is featureless and does not invite tampering or experimentation, and in normal use is mounted where it is relatively invisible or inaccessible, and the user is not required to physically access or approach it for any reason when it is actually operating and in use. In general, a coded radio transmission is the preferred form of remote control signal. An infrared transmission, as commonly used in television controllers, is less desirable since this requires a line of sight transmission, which is partly inconsistent with the invention's feature of inconspicuous operation. Ultrasonic transmission, however, is more acceptable for the sending unit, than is infrared, and other forms of remote transmission are also possible. The communication coupling may be by RF elements, LED/photodiode elements, or piezoelectric or other ultrasonic elements.

Use of the device is straightforward. A parent determines the rules governing television watching in the household and simply disables the television at hours when watching is not permitted at all. This is done by pressing the button on the transmission unit, transmitting a signal that is received, demodulated and provided as a change-state signal to the relay or switch element to make the receiver turn off the switch. The receiving unit may further have an LED or other visible indicator connected to the switched contacts within the box (that is, to the contacts for television plug 50) to provide a visible indication when power has been enabled. In an alternative embodiment, two color indicators, such as both red and green LEDs, may be provided to indicate the respective ON/OFF status of the switch 39 (FIG. 2) so that the operator can tell at a glance, without flicking the television on or off, whether the control box contacts are open or closed. In the latter case, bridge or logic voltage comparison or discrimination circuitry may be provided to assure that the correct LED is illuminated. Other light combinations may be provided to indicate with one light that the control box that is plugged in, and with one or more other lights, that it is turned ON or OFF.

In addition to controlling television or video games, the present invention may also be used as a power control for a personal computer or similar piece of equipment. In general, applicant contemplates that the switch unit or relay 39 (FIG. 2) have a power switching capacity in the range of 4–8 amperes or more and be able to switch loads having a power consumption in the range of up to 300–1,000 watts. This range, and preferably 400–600 watts, provides broad utility for a variety most commonly encountered devices. However, for extremely large or high powered consumption television, a more powerful switch capacity is also contemplated.

Where large amounts of power are likely to be dissipated within the control unit itself, its housing may be formed of a relatively high melting point or high extrusion pressure plastic. A preferred form of fabrication of the locking housing of the receiver unit is by injection molding, and in that case a number of protrusions, indentations, latches and positioning, securing or locking elements may all be integrally formed with the molded housing in one operation. In other embodiments, the circuitry of the receiver unit may be located physically within the television, behind the rear cover housing of the television, and may be attached to circuitry to either disconnect power coming in at the line cord, or to disconnect some other conductor which is effective to disable the TV. Such other conductor may, for example, be a line to an RF demodulator circuit or channel selector, in which case the television display would light up and its speakers make noise, but would only display static. Alternatively, the switch may be attached to disconnect a major circuit component, such as a magnet yoke, an amplifier or a flyback transformer. In any of these embodiments, the tamper-proof rear cover of the television is the secure housing of the receiver. However, security is still further provided by the narrow band or coded aspects of the transmitting unit and by corresponding discrimination in the receiver necessary to enable the switch.

The invention being thus disclosed and illustrated, further variations and modifications will occur to those skilled in the art, and all such variations and modifications are considered to be within the scope of the invention, as defined in the claims appended hereto.

What is claimed is:

1. Apparatus for use by a person to secure an electrically operated domestic video display device against unauthorized use, wherein the device includes a power line connected via a domestic power line plug to a source of power for powering operation of said device, and includes a power switch for normally turning the device on and off such apparatus comprising a transmitter unit for transmitting a wireless security signal, said transmitter unit including manual actuation means for manually actuating the unit to transmit, and a receiving unit separate and distinct from the transmitting unit for remotely receiving and implementing said wireless security signal, wherein the receiving unit includes first means configured to receive the wireless security signal and produce an indication of reception thereof switch means, responsive to said indication of reception for changing between OFF and ON states, said switch means being attached in said power line to disconnect the source of power rendering the device inoperative in said OFF state, a tamper-proof housing enclosing said first means and said switch means of said receiving unit and also enclosing a socket for receiving a domestic power line plug, the socket being wired through said switch means to a plug assembly for providing power to the switch means, and wherein said tamper-proof housing encloses and secures the domestic power line plug of the device to said socket so that power enters the device only when enabled by said transmitter unit, and so that once connected in said power line the receiving unit disables the electrically operated display device when said switch means is in an OFF state, wherein the housing constitutes a featureless attachment to said device to effectively hide presence and functioning said switch means, so that behavioral control issues between the person and child over use of the device do not arise, and whereby actuation of the transmitter unit remotely disables the electrically operated display device and the switch means cannot be bypassed to provide power for operating the device without tell-tale destruction or tampering of said housing.

2. Apparatus according to claim 1, wherein the first means includes means for demodulating the wireless security signal to produce a demodulated discrimination signal.

3. Apparatus according to claim 2, wherein the first means further includes means for decoding the demodulated discrimination signal.

4. Apparatus according to claim 1, wherein the receiving unit is located within a housing of said device, and the device housing is the tamper-proof housing, and wherein said switch means disconnects the power line of said device.

5. Apparatus according to claim 4, wherein the device is a television, and said transmitting unit is incorporated in a remote controller of said television so as to transmit a coded transmission signal for turning the television ON.

6. Apparatus according to claim 5, wherein said receiving unit enables power ON in series with an ON/OFF switch of said device.

7. Apparatus according to claim 1, wherein said tamper-proof housing forms a featureless case enclosing an end of said power line.

8. Apparatus according to claim 7, wherein said tamper-proof housing is a self-locking clam shell housing.

9. Apparatus according to claim 7, wherein said tamper-proof housing comprises a pair of half-boxes, and means for locking said pair together to form a substantially featureless enclosure.

10. Apparatus for securing an electrically operated domestic video display device against unauthorized operation by children, such apparatus comprising a locking housing which fits about a power line plug from the domestic display device a switch within the locking housing connected to the power line plug to selectively control power thereto, and a signal receiver and discrimination circuit located within the housing and being operative upon receipt of a remote transmission signal to operate the switch said apparatus being configured to plug into an outlet to receive power for said device, and said housing connecting and providing a featureless extension of said power line plug enclosing both the power line plug and switch, thus effectively hiding the presence of said switch, so that by remotely sending the transmission signal the switch is remotely operated to control whether power reaches the domestic display device and thereby selectively allow children to operate the device without appearing to exercise control.

11. Apparatus according to claim 10, wherein said apparatus is configured with a plug of a size to fit in a domestic electronics chassis socket array.

12. Apparatus according to claim 10, further comprising an LED in said housing for indicating ON/OFF state of said switch.

* * * * *